US012643580B2

(12) United States Patent
Krzanowski et al.

(10) Patent No.: US 12,643,580 B2
(45) Date of Patent: Jun. 2, 2026

(54) WHEEL ARRANGEMENT FOR A RAIL VEHICLE

(71) Applicant: Bombardier Transportation GmbH, Berlin (DE)

(72) Inventors: Lukasz Krzanowski, Siegen (DE); Daniel Wagener, Wilnsdorf (DE)

(73) Assignee: Bombardier Transportation GmbH, Berlin (DE)

( * ) Notice: Subject to any disclaimer, the term of this patent is extended or adjusted under 35 U.S.C. 154(b) by 1048 days.

(21) Appl. No.: 17/475,186

(22) Filed: Sep. 14, 2021

(65) Prior Publication Data

US 2022/0081014 A1 Mar. 17, 2022

(30) Foreign Application Priority Data

Sep. 16, 2020 (EP) ..... 20196393

(51) Int. Cl.
*B61F 5/32* (2006.01)
*B61F 3/16* (2006.01)
*B61F 5/52* (2006.01)

(52) U.S. Cl.
CPC ..... *B61F 5/325* (2013.01); *B61F 3/16* (2013.01); *B61F 5/52* (2013.01)

(58) Field of Classification Search
CPC ..... B61F 5/26; B61F 5/305325; B61F 5/52; B61F 3/16; B60B 17/0006; B60B 17/0027; B60B 17/0034; B60B 9/005; B60B 37/10; B60B 2900/131; B60B 9/12; B60Y 2200/30; B61C 3/00
USPC ..... 295/11; 225/37
See application file for complete search history.

(56) References Cited

U.S. PATENT DOCUMENTS 2,097,970 A 11/1937 Edmunds
3,334,596 A * 8/1967 Suri ..... B61F 3/16 105/169
4,058,065 A * 11/1977 Seifert ..... B60F 1/02 384/191.1

(Continued)

FOREIGN PATENT DOCUMENTS

CN 101132936 A * 2/2008 ..... B60G 7/00
CN 101368609 A * 2/2009

(Continued)

OTHER PUBLICATIONS

Notice of Issuance in Chinese Application No. 202111081376.6, dated Apr. 17, 2025, 10 pages including machine translation.

*Primary Examiner* — S. Joseph Morano
*Assistant Examiner* — Eva L Comino
(74) *Attorney, Agent, or Firm* — Morgan, Lewis & Bockius LLP

(57) ABSTRACT

A rail vehicle, such as a light rail vehicle, can include a wheel unit and a support unit. The wheel unit can define an axis of rotation of the wheel unit. The support unit can be configured to be connected to a rail vehicle structure that defines a vehicle longitudinal direction, a vehicle transverse direction, and a vehicle height direction. The support unit can be configured to connect the wheel unit to the rail vehicle structure such that the wheel unit is rotatable about the axis of rotation. The support unit can also include a primary suspension unit configured to provide resilient support of the rail vehicle structure on the wheel unit at least in the vehicle height direction.

19 Claims, 2 Drawing Sheets

(56) References Cited

U.S. PATENT DOCUMENTS

| | | | | |
|---|---|---|---|---|
| 6,732,775 | B1 * | 5/2004 | Kikuchi | B60B 9/12 152/48 |
| 7,306,065 | B2 * | 12/2007 | Nagaya | F16F 15/18 280/124.157 |
| 2010/0294163 | A1 * | 11/2010 | Walter | B61F 5/386 105/168 |
| 2013/0018535 | A1 * | 1/2013 | Schneider | B61F 9/00 701/19 |
| 2013/0228994 | A1 | 9/2013 | Davy et al. | |
| 2020/0164902 | A1 | 5/2020 | Bieker et al. | |

FOREIGN PATENT DOCUMENTS

| | | | | | |
|---|---|---|---|---|---|
| CN | 102448790 | A | | 5/2012 | |
| CN | 204399181 | U | | 6/2015 | |
| CN | 106314469 | A | * | 1/2017 | B61F 5/24 |
| CN | 107628052 | | | 1/2018 | |
| CN | 107628052 | A | * | 1/2018 | B61F 5/28 |
| CN | 107791767 | A | | 3/2018 | |
| CN | 108317199 | A | * | 7/2018 | F16F 1/387 |
| CN | 108349510 | A | | 7/2018 | |
| CN | 111216499 | A | | 6/2020 | |
| DE | 3218088 | C2 | * | 3/1992 | B61F 5/38 |
| EP | 1065122 | A1 | * | 1/2001 | B61C 9/52 |
| EP | 1065122 | | | 2/2004 | |
| EP | 3012172 | | | 4/2016 | |
| EP | 3159238 | | | 4/2017 | |
| EP | 3159238 | A1 | * | 4/2017 | B61F 5/04 |
| GB | 1074535 | | | 7/1967 | |
| WO | WO-2014040715 | A1 | * | 3/2014 | F03D 1/0658 |
| WO | WO 2015/004998 | | | 1/2015 | |
| WO | WO-2015004998 | A1 | * | 1/2015 | B61F 3/16 |

* cited by examiner

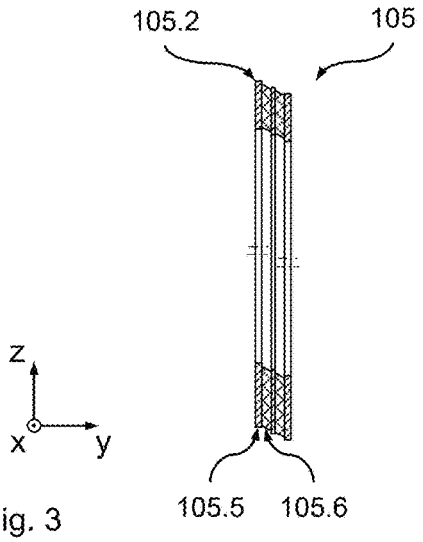
Fig. 3
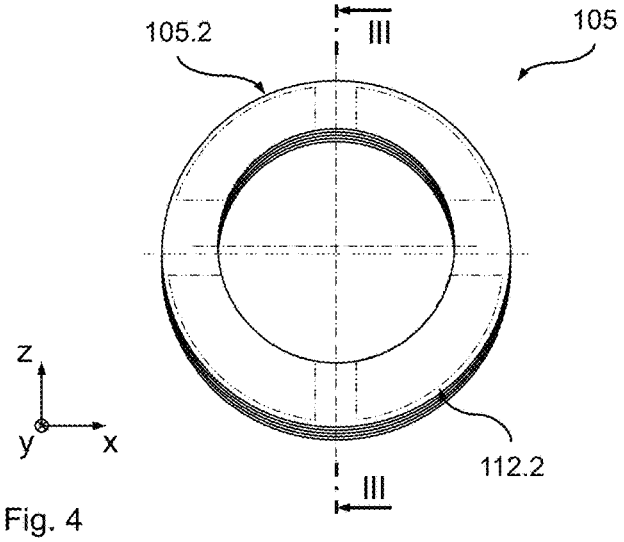
Fig. 4
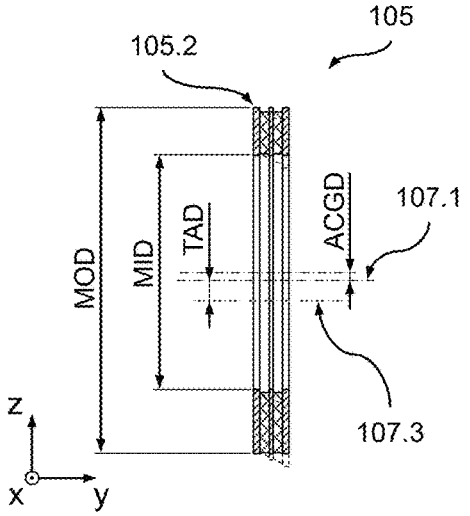
Fig. 5
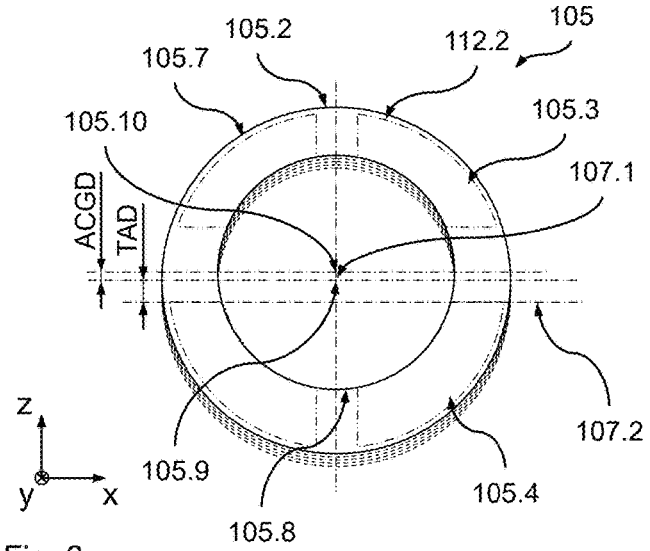
Fig. 6
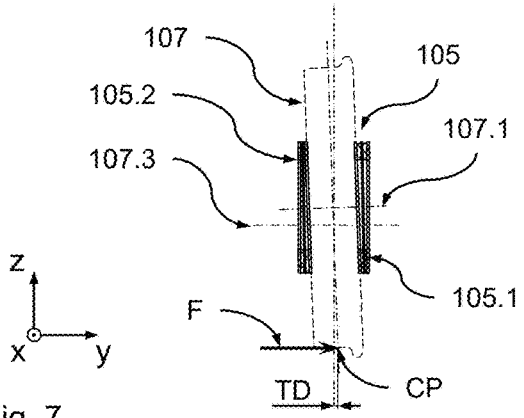
Fig. 7
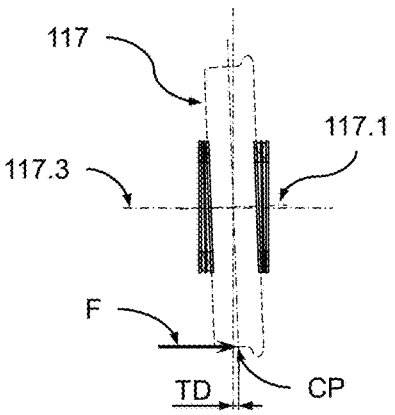

WHEEL ARRANGEMENT FOR A RAIL VEHICLE

CROSS-REFERENCE TO RELATED APPLICATIONS

This application claims priority under 35 U.S.C. § 119(a) to European Patent Application No. 20196393.1, filed Sep. 16, 2020, the entirety of which is incorporated herein by reference.

BACKGROUND OF THE INVENTION

The present invention relates to a wheel arrangement for a rail vehicle, in particular, a light rail vehicle, comprising a wheel unit and a support unit, wherein the wheel unit defines an axis of rotation of the wheel unit. The support unit is configured to be connected to a rail vehicle structure of the rail vehicle defining a vehicle longitudinal direction, a vehicle transverse direction and a vehicle height direction. The support unit is further configured to connect the wheel unit to the rail vehicle structure such that the wheel unit is rotatable about the axis of rotation. The support unit comprises a primary suspension unit configured to provide resilient support of the rail vehicle structure on the wheel unit at least in the vehicle height direction. The primary suspension unit has a primary suspension transverse rigidity in a direction parallel to the axis of rotation, wherein a distribution of the primary suspension transverse rigidity across the primary suspension unit, in particular, in a static state of the rail vehicle standing on a straight level track under a nominal load, defines a tilt axis of the wheel unit parallel to the vehicle longitudinal direction. The invention further relates to a corresponding rail vehicle unit comprising a rail vehicle structure and at least one such wheel arrangement.

In a rail vehicle, the primary suspension represents the transition from the so-called unsprung mass, i.e., the part of the vehicle which is directly subject to the loads introduced via the track without the interposition of a spring element (and, typically, also a damping element), and the remainder of the vehicle. With conventional running gears for rail vehicles the primary suspension is typically arranged between the axle or wheel set shaft of the wheel unit (e.g., a single wheel, a wheel pair or a wheel set) and a vehicle structure, typically a running gear frame of the vehicle or eventually even the wagon body structure itself. Such a configuration is known, for example, from EP 1 065 122 B1 (the entire disclosure of which is incorporated herein by reference).

For passenger comfort and vehicle dynamics reasons, in particular, in so-called light rail vehicles (LRV), it is typically desired to reduce the unsprung mass as far as possible. Hence, typically, rail vehicle manufacturers strive to make the components forming the unsprung mass as light as possible. However, this approach has its clear limitations in terms of structural integrity and safety requirements.

A further problem with this kind of primary suspension can be the comparatively low lateral stiffness or transverse rigidity of such primary spring configurations, especially if the wheel unit is a single wheel subject to lateral loads introduced at the wheel to rail contact point (e.g., as constantly present for wheel to rail pairings with a certain conicity, but also as impact loads when running over a switch or an irregularity in the track). While a low transverse rigidity may be desired under the aspect of passenger comfort, especially with such single wheel running gears a comparatively high transverse rigidity of the primary suspension may be required under the aspect of derailment safety in order to guarantee proper wheel to rail contact under any such lateral load conditions to be expected during operation of the rail vehicle.

In the field of industrial transport carts and lift trucks it is generally known, for example from EP 0 104 714 B1 (the entire disclosure of which is incorporated herein by reference), to use a single wheel suspension configuration with so called shear pads, typically layered metal rubber springs, wherein the layers of the respective shear pad are arranged perpendicular to the axis of rotation of the wheel. Such a configuration may be useful to considerably increase the transverse rigidity without compromising the rigidity in the height direction in such non-track bound industrial transport carts and lift trucks, where passenger comfort and derailment safety however play no role. This concept is however not easily transferred to rail vehicle applications where, to the contrary, passenger comfort and derailment safety play a significant role but are competing goals.

SUMMARY OF THE INVENTION

Thus, it is the object of the present invention to provide a wheel arrangement for a rail vehicle and a rail vehicle unit as described above, which do not show the disadvantages described above, or at least show them to a lesser extent, and, in particular, allows in a simple, space saving and efficient manner high derailment safety while at the same time keeping the unsprung mass low and maintaining high passenger comfort during operation of the rail vehicle.

The above objects are achieved starting from a wheel arrangement according to the preamble of claim 1 by the features of the characterizing part of claim 1.

The present invention is based on the technical teaching that, it is possible to achieve in a simple, space saving and efficient manner high derailment safety while at the same time keeping the unsprung mass low and maintaining high passenger comfort during operation of the rail vehicle if the primary suspension unit is configured such that the (virtual) tilt axis of the wheel unit is located below the axis of rotation of the wheel unit (it should be noted that, unless explicitly stated otherwise, geometric relations such as "above" and "below" given herein in relation to the vehicle height direction). This tilt axis (in the static state of the rail vehicle standing on a straight level track under the vehicle's nominal load) runs parallel to the vehicle longitudinal direction and is defined by the distribution of the transverse rigidity of the primary suspension unit. More precisely, as the primary suspension unit is typically located above the wheel to rail contact location, a transverse force or lateral load acting in the transverse direction at the wheel to rail contact (e.g., as constantly present for wheel to rail pairings with a certain conicity, but also as impact loads as a result of track irregularities or the like) results not only in a transverse (or lateral) deflection of the wheel unit but also in a tilt motion of the wheel unit (also referred to as a lateral track load induced tilt herein) about this tilt axis which is defined by the primary suspension unit, more precisely, by the distribution of the transverse rigidity of the primary suspension unit in the height direction.

The invention has realized that this tilt motion in response to such transverse forces has a considerable impact on the deflection of the wheel unit at the wheel to rail contact location, and, hence, on the derailment safety. Moreover, the invention has realized that, by selecting a suitable distribution of the transverse rigidity of the primary suspension unit which locates this (virtual) tilt axis below the axis of rotation of the wheel unit, such tilt related deflections of the wheel unit can be reduced and, thus, derailment safety can be increased while at the same time the keeping the overall transverse rigidity of the primary suspension unit unchanged. In particular, it is also possible to keep the rigidity in the height direction essentially unchanged. Hence, the unsprung mass may be kept low and passenger comfort may be maintained while reducing the derailment risk or, put otherwise, passenger comfort may be increased and the unsprung mass may be reduced while keeping a given low level of the derailment risk.

It will be appreciated that this concept is particularly useful and effective in singe wheel configurations where the primary suspension unit is the (eventually even only) component defining this tilt axis. However, use of the above concept is not limited to single wheel configurations and, for essentially the same reasons as given above, may also have beneficial effects with other configurations (such as e.g., wheel pairs or wheel sets) where a mechanical coupling exists between the two wheel units on both sides of the running gear.

Hence, according to one aspect, the present invention relates to a wheel arrangement for a rail vehicle, in particular, a light rail vehicle, comprising a wheel unit and a support unit, wherein the wheel unit defines an axis of rotation of the wheel unit. The support unit is configured to be connected to a rail vehicle structure of the rail vehicle defining a vehicle longitudinal direction, a vehicle transverse direction and a vehicle height direction. The support unit is further configured to connect the wheel unit to the rail vehicle structure such that the wheel unit is rotatable about the axis of rotation. The support unit comprises a primary suspension unit configured to provide resilient support of the rail vehicle structure on the wheel unit at least in the vehicle height direction. The primary suspension unit has a primary suspension transverse rigidity in a direction parallel to the axis of rotation, wherein a distribution of the primary suspension transverse rigidity across the primary suspension unit, in particular, in a static state of the rail vehicle standing on a straight level track under a nominal load, defines a tilt axis of the wheel unit parallel to the vehicle longitudinal direction. The distribution of the primary suspension transverse rigidity is such that, in the vehicle height direction, the tilt axis is located below the axis of rotation.

It will be appreciated that, basically, any desired height offset of the tilt axis from the axis of rotation that has a noticeable positive effect on the lateral track load induced tilt can be sufficient. Typically, the wheel unit has a rail contact surface defining a nominal diameter of the wheel unit (typically in a new, unworn state of the wheel, but possibly also, in a re-profiled state of the wheel), and the tilt axis, in the vehicle height direction, in particular, in the static state of the rail vehicle, is located at a tilt axis distance from the axis of rotation. Preferably, the tilt axis distance is at least 10%, preferably at least 20%, more preferably 15% to 50%, in particular, 25% to 40%, of the nominal diameter. These configurations achieve a particularly advantageous reduction of the lateral track load induced tilt of the wheel unit.

The distribution of the primary suspension transverse rigidity can have any desired configuration as long as the desired height offset of the tilt axis with respect to the axis of rotation is achieved. With particularly simple variants, the primary suspension unit is separated in an upper, first primary suspension part and a lower, second primary suspension part. The first primary suspension part has a first transverse rigidity in the direction parallel to the axis of rotation, wherein the first primary suspension part, in the static state of the rail vehicle, is located, in the vehicle height direction, above the axis of rotation. The second primary suspension part has a second transverse rigidity in the direction parallel to the axis of rotation, wherein the second primary suspension, in the static state of the rail vehicle, is located, in the vehicle height direction, below the axis of rotation. The first transverse rigidity is lower than the second transverse rigidity, thereby achieving the desired height offset of the tilt axis with respect to the axis of rotation. Preferably, the first transverse rigidity is 5% to 99%, preferably 25% to 75%, more preferably 40% to 60%, of the second transverse rigidity, thereby achieving particularly beneficial results.

It will be appreciated that the above distribution of the primary suspension transverse rigidity may simply be achieved by two separate primary suspension elements (one forming the upper primary suspension part, one forming the lower primary suspension part). It may of course also be formed by any desired other number of primary suspension elements in either of the upper and lower primary suspension part. Similarly, as will be explained further below, one single primary suspension element may be sufficient to achieve this distribution.

Basically, any desired type(s) of primary suspension element(s) may be used to form the primary suspension unit achieving resilient primary suspension in the required degrees of freedom. In particular, primary suspension elements of any desired configuration and shape may be used. These may comprise conventional spring elements, such as, for example helical metal spring elements or rubber spring elements alone or in combination with other components, such as, for example, damping elements etc.

With simple and particularly space saving preferred configurations, the primary suspension unit is a shear spring unit. Such shear spring units typically have the advantage that they provide suitable spring motion in their shear direction, typically in a shear plane, while being comparatively rigid in other directions (e.g., in a direction perpendicular to a shear plane of the shear spring unit). Preferably, the shear spring unit comprises at least one primary suspension element in the form of a shear spring element, configured to provide resilient support of the rail vehicle structure on the wheel unit. Such shear spring elements are well-known in the art and readily available in multiple configurations. Preferably, the at least one primary suspension element is arranged and configured such that, in the static state of the rail vehicle, the primary suspension element is at least primarily under a shear stress, in particular, is at least substantially exclusively, under a shear stress. By this means particularly compact yet effective configurations are achieved.

With certain simple and preferred variants, the primary suspension unit comprises at least one primary suspension element configured to provide resilient support of the rail vehicle structure on the wheel unit, wherein the primary suspension element comprises at least one of a polymer element, a rubber element, and a laminated rubber metal spring element with a plurality of layers. Preferably, the plurality of layers is configured to extend, in the static state of the rail vehicle, in a plane perpendicular to the transverse direction. In any of these cases, in a very compact configuration, particularly favorable suspension in the height direction may be achieved with at the same time appropriate transverse rigidity.

It will be appreciated that, in general, the overall or total rigidity of the primary suspension unit may be substantially the same in all three (translatory) directions, i.e., the longitudinal direction, the transverse direction and the height direction. However, with certain embodiments, the primary suspension unit may have different behavior in different directions in order to account for the load cases to be expected during operation of the particular vehicle the wheel arrangement is to be operated on. Hence, with certain preferred variants, the primary suspension unit has a longitudinal rigidity in the longitudinal direction, the transverse rigidity and a height rigidity in the height direction (i.e., in three mutually orthogonal directions). With certain variants, the height rigidity is lower than at least one of the longitudinal rigidity and the transverse rigidity (typically at least lower than the transverse rigidity). By this means, a primary suspension may be achieved which is suitably compliant in the height direction of the vehicle, while being comparatively rigid at least in the transverse direction of the vehicle. In addition or as an alternative, the longitudinal rigidity is lower than the transverse rigidity. In many embodiments according to the present design, the height rigidity may be at least approximately the same as the longitudinal rigidity.

As noted above, one single primary suspension element may be sufficient to achieve the desired distribution of the primary suspension transverse rigidity. Hence, with certain variants, the primary suspension unit comprises at least one ring shaped primary suspension element providing resilient support of the rail vehicle structure on the wheel unit. The at least one primary suspension element may extend along an outer circumference of an axle unit of the support unit, thereby achieving a particularly compact yet efficient configuration.

The desired distribution of the primary suspension transverse rigidity may be achieved in any suitable way by properly choosing the materials used for the at least one primary suspension element and/or by properly distributing the material(s) used for the at least one primary suspension element and/or by properly choosing the dimensions of the at least one primary suspension element.

With certain particularly simple, space saving and, hence, preferred variants, the at least one ring shaped primary suspension element has a plane of main extension, wherein the at least one ring shaped primary suspension element, in this plane of main extension, has an outer circumferential contour with a maximum outer diameter and an inner circumferential contour with a maximum inner diameter. The outer circumferential contour defines a first area center of gravity, whereas the inner circumferential contour defines a second area center of gravity. To achieve the desired distribution of the primary suspension transverse rigidity, the second area center of gravity, in the vehicle height direction, is upwardly offset from the first area center of gravity by an area center of gravity distance, the area center of gravity distance, in particular, being 5% to 25%, preferably 7.5% to 15%, more preferably 9% to 12%, of the maximum outer diameter. Moreover, in addition or as an alternative, the first area center of gravity and the second area center of gravity may be at least substantially aligned in the vehicle height direction, thereby also achieving a particularly simple and compact configuration.

The respective outer and inner contour may have any desired and suitable shape. For example, the respective outer and inner contour may be at least section-wise polygonal and/or least section-wise curved. Particularly simple arrangement are achieved, if at least one of the outer circumferential contour and the inner circumferential contour is an at least essentially elliptic contour, in particular, an at least essentially circular contour.

The dimensions of the respective outer and inner contour may be chosen as desired and suitable for the respective rail vehicle. With preferred variants, the maximum outer diameter ranges from 100 mm to 1000 mm, preferably 150 mm to 750 mm, more preferably 200 mm to 500 mm. In addition or as an alternative the maximum inner diameter may range from 50 mm to 900 mm, preferably 75 mm to 700 mm, more preferably 100 mm to 400 mm. In addition or as an alternative, the area center of gravity distance may range from 25 mm to 500 mm, preferably 50 mm to 250 mm, more preferably 75 mm to 100 mm.

As already noted above, with certain further variants the primary suspension unit may comprise a plurality of primary suspension elements providing resilient support of the rail vehicle structure on the wheel unit. In these cases, the plurality of primary suspension elements may be distributed along an outer circumference of an axle unit of the support unit, thereby achieving a compact configuration. Again, the primary suspension unit may be separated in an upper primary suspension part and a lower primary suspension part, wherein the upper primary suspension part, in the static state of the rail vehicle, is located, in the vehicle height direction, above the axis of rotation, while the lower primary suspension part, in the static state of the rail vehicle, is located, in the vehicle height direction, below the axis of rotation.

Preferably, to achieve the desired distribution of the primary suspension transverse rigidity, a number of the primary suspension elements in the upper primary suspension part is lower than a number of the primary suspension elements in the lower primary suspension part. In addition or as an alternative, to achieve the desired distribution of the primary suspension transverse rigidity, a size of at least one of the primary suspension elements in the upper primary suspension part may be smaller than a size of at least one of the primary suspension elements in the lower primary suspension part.

It will be appreciated that the primary suspension unit can basically be located at any desired and suitable point along the kinematic chain between the wheel unit and the vehicle structure. In particular, the primary suspension unit may be located more or less remote from the wheel unit. With preferred variants showing a very low unsprung mass (see above), the primary suspension unit is located as close as possible the wheel unit along this kinematic chain. Preferably, the support unit comprises an axle unit with a wheel bearing unit and a wheel support unit, wherein the wheel bearing unit forms a bearing for the wheel unit. Here, to achieve a low unsprung mass, the primary suspension unit is located kinematically in series between the wheel support unit and the wheel bearing unit, such that the wheel support unit is supported on the wheel bearing unit via the primary suspension unit.

Particularly compact yet lightweight configurations may be achieved if the wheel support unit is essentially tube shaped. It will be appreciated that the primary suspension concept as disclosed herein may in general be used in the context of driven or non-driven wheel units. Hence, with certain variants, a drive shaft unit, at a first end, may be connected to the wheel unit, wherein the drive shaft unit extends through an interior section of an essentially tube shaped wheel support unit. The drive shaft unit, at a second end opposite to the first end, may be configured to be connected to a drive unit of the rail vehicle. To this end, the drive shaft unit may have a toothed section configured to connect to the drive unit.

With certain variants, a gap is formed between the wheel support unit and the wheel bearing unit, and the primary suspension unit is connected to the wheel support unit and the wheel bearing unit, wherein the primary suspension unit bridges at least a part of the gap between the wheel support unit and the wheel bearing unit. By this means a very simple integration of the primary suspension of unit may be achieved. In particular, the location and orientation of the gap and the bridging primary suspension unit may be comparatively easily adapted to the loads to be expected during operation.

Here, two primary types of relative motion between the parts of the wheel support unit and the wheel bearing unit forming the bridged part of the gap may be taken into account. One is essentially a shear motion which then typically leads to the use of one or more shear spring elements for the primary suspension unit, whereas the other one is essentially a normal or breathing motion (increasing or decreasing the width of the gap) which typically leads to the use of one or more compression spring elements for the primary suspension unit. Of course, eventually, any combination of these motions and spring elements, respectively, may also be used, in particular, depending on the loads to be expected during operation of the vehicle.

It will be appreciated that, preferably, the primary suspension unit, in a neutral or unloaded state, is under a compressive pre-stress in the transverse direction in order to properly adjust the transverse stiffness (to a given desired level already in that neutral state with no transverse load acting on the wheel unit). This compressive pre-stress may simply be achieved by properly selecting the dimensions of the primary suspension unit and the gap in the transverse direction.

With certain particularly compact and favorable variants, the wheel bearing unit has a recess, and the wheel support unit at least partially extends into the recess. This reaching into the recess of the wheel bearing unit has several advantages, one being the fact that this allows a particularly compact design. Another advantage being the possibility to have the wheel support unit reach through this recess and provide support on both lateral sides of the wheel bearing unit. Such a configuration is also particularly beneficial in terms of failure safety and failure running properties, since even upon failure of the primary suspension unit dislocation of the wheel unit from the axle unit may prevented by simple safety means. Hence, with preferred variants, the wheel support unit extends through the recess.

The above recess of the wheel bearing unit may generally be of any arbitrary design and shape as long as it allows the wheel support units to reach into the recess. With particularly simple variants allowing compact designs, the recess has a recess axis, the recess axis, in an unloaded state of the wheel arrangement, extending at least substantially parallel to the wheel axis of rotation.

It will be appreciated that, generally, one single primary suspension element may be sufficient to achieve the desired primary suspension. Preferably, the wheel unit has an inner side and an outer side, the wheel unit being configured such that, during use of the rail vehicle on a track, the inner side faces towards a center of the track and the outer side faces away from the center of the track. Here, at least one inner primary suspension element of the primary suspension unit may be located on the inner side of the wheel bearing unit, whereas at least one outer primary suspension element of the primary suspension unit is located on the outer side of the wheel bearing unit. By this means, particularly compact yet robust configurations may be achieved.

The present invention further relates to a rail vehicle unit comprising a rail vehicle structure, and at least one wheel arrangement according to the invention connected to the rail vehicle structure. It will be appreciated that the rail vehicle structure may comprise an entire rail vehicle or a wagon body of the rail vehicle, respectively. With further variants, the rail vehicle structure may comprise a running gear unit, in particular, a running gear frame, connected to the at least one wheel arrangement. As noted above, the primary suspension concept as disclosed herein is particularly useful if the at least one wheel arrangement is a single wheel arrangement. With such a rail vehicle unit the above variants and advantages can be achieved to the same extent, such that reference is made to the explanations given above.

The invention is explained in greater detail below with reference to embodiments as shown in the appended Figures.

BRIEF DESCRIPTION OF THE DRAWINGS

FIG. 3 is a schematic sectional view of a primary suspension element of the wheel arrangement of FIG. 2 along line III-III of FIG. 4 in an unloaded state.

FIG. 4 is a schematic side view of the primary suspension element of FIG. 3.

FIG. 5 is a schematic sectional view of the primary suspension element of FIG. 3 in a loaded state (in a static state of the vehicle of FIG. 1).

FIG. 6 is a schematic side view of the primary suspension element of FIG. 5.

FIG. 7 is a schematic illustration comparing the tilt behavior of the wheel arrangement of FIG. 1 with a conventional wheel arrangement.

DETAILED DESCRIPTION OF THE INVENTION

Figure 1:
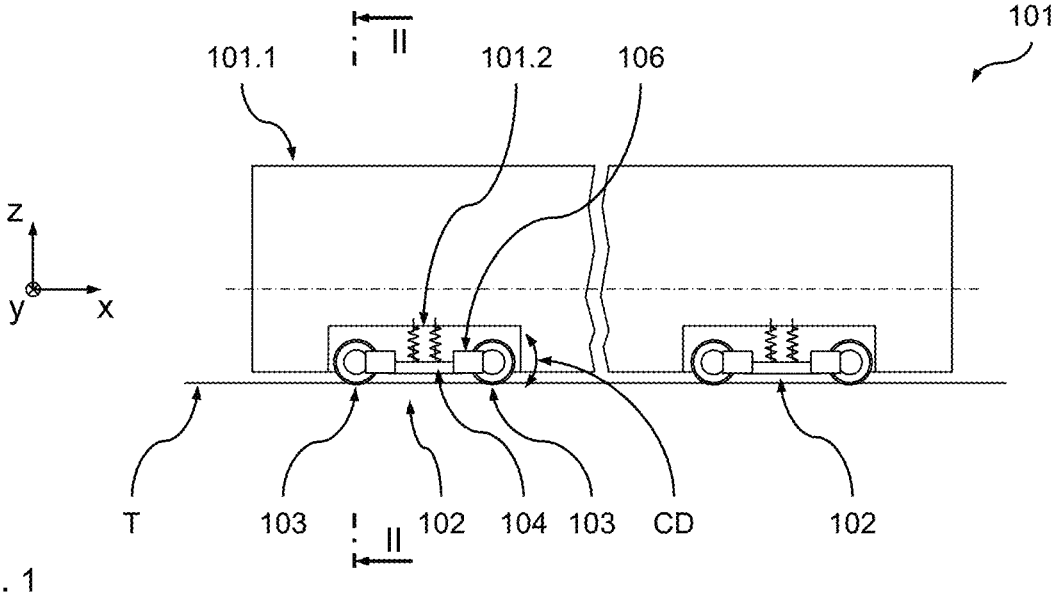
FIG. 1 is a schematic side view of a part of a preferred embodiment of a rail vehicle according to the present invention with a preferred embodiment of a wheel arrangement according to the present invention.

With reference to FIGS. 1 to 7 preferred embodiments of a rail vehicle 101 according to the present invention comprising a preferred embodiment preferred of a running gear 102 according to the invention further comprising a preferred embodiment of a wheel arrangement 103 according to present the invention will now be described in greater detail.

In order to simplify the explanations given below, an xyz-coordinate system has been introduced into the Figures, wherein (on a straight, level track T) the x-axis designates the longitudinal axis (or direction, respectively) of the rail vehicle 101, the y-axis designates the transverse axis (or direction, respectively) of the rail vehicle 101 and the z-axis designates the height axis (or direction, respectively) of the rail vehicle 101 (the same, of course, applies for the running gear 102). It will be appreciated that all statements made in the following with respect to the position and orientation of components of the rail vehicle, unless otherwise stated, refer to a static situation or state of the rail vehicle 101 with the rail vehicle 101 standing on a straight level track under nominal loading.

The vehicle 101 is a low floor light rail vehicle (LRV) such as a tramway or the like. The vehicle 101 comprises a wagon body 101.1 supported by a suspension system on the running gear 102. The running gear 102 comprises four wheel arrangements 103 according to the invention supporting a vehicle structure in the form of the running gear frame 104. Each wheel arrangement 103 integrates a primary suspension unit 105, while the running gear frame 104 supports the wagon body via a secondary suspension unit 101.2.

In the present example, each of the wheel arrangements 103 is a motorized wheel arrangement 103 driven by a drive unit 106 which typically includes a motor and an associated gearbox. Of course, with certain variants, one motor may drive more than one wheel arrangement 103 via a corresponding gears etc. Similarly, with other variants, some or all of the wheel arrangements 103 may be non-motorized.

Figure 2:
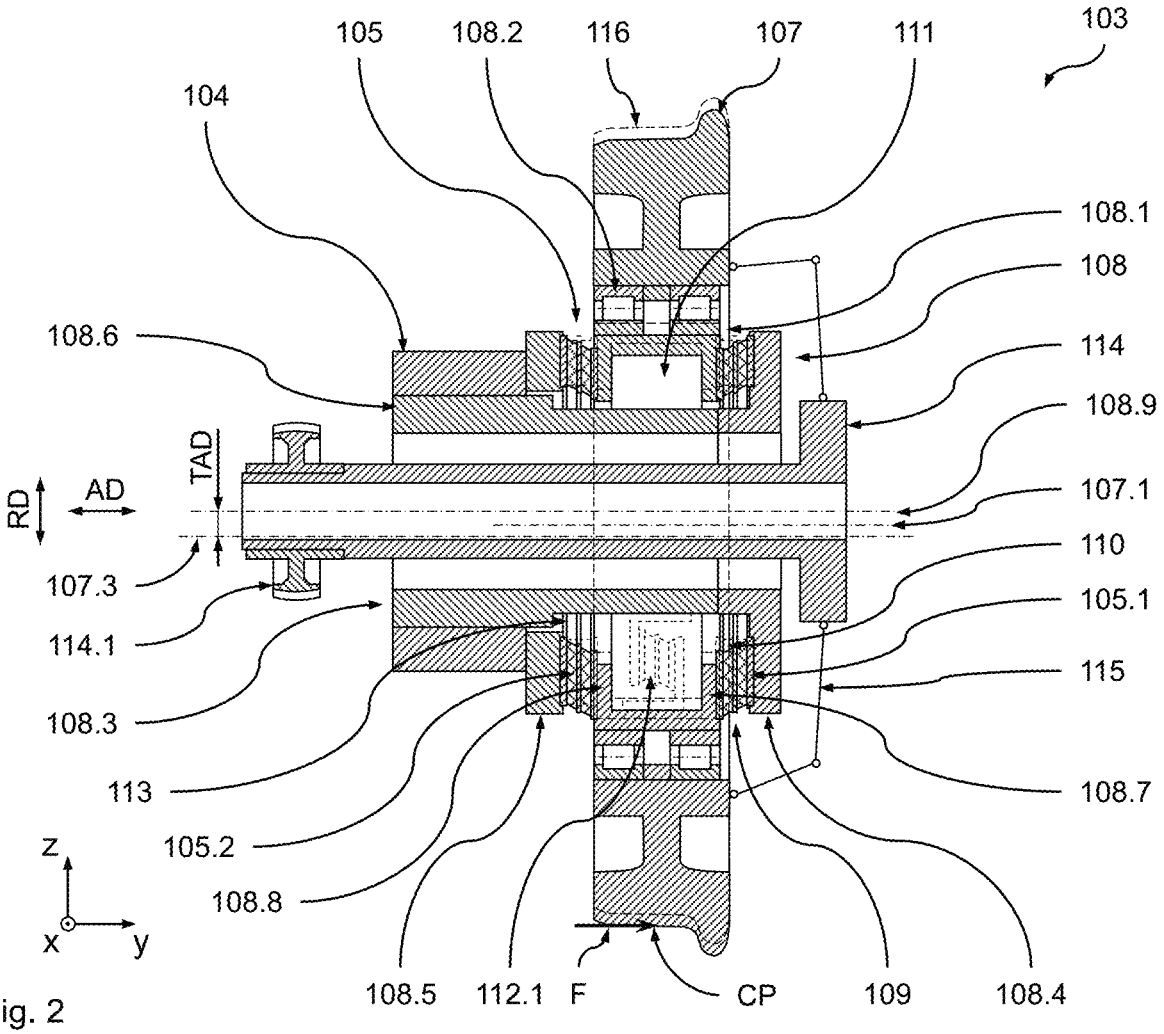
FIG. 2 is a schematic partially sectional view of the wheel arrangement of FIG. 1 along line II-II of FIG. 1.

As can be seen from FIG. 2, the wheel arrangement 103 comprises a wheel unit 107 and a support unit in the form of an axle unit 108. In the mounted state as shown, the axle unit 108 is connected to the rail vehicle structure (running gear frame 104) of the rail vehicle 101. The wheel unit 107 rotatably supports the axle unit 108 or vice versa. To this end, the axle unit 108 comprises a wheel bearing unit 108.1, wherein the wheel bearing unit comprises a bearing 108.2 to form a bearing for the wheel unit 107 and to define a wheel axis of rotation 107.1 of the wheel unit 107 during operation of the rail vehicle 101. In the present example, the bearing 108.2 is a conventional roller bearing. It will be appreciated, however, that with other variants, any other type of bearing providing suitable role in support to the wheel unit 107 may be used.

The axle unit 108 further comprises a wheel support unit 108.3 and a primary suspension unit 105. The primary suspension unit 105 is located kinematically in series between the wheel support unit 108.3 and the wheel bearing unit 108.1, such that the wheel support unit 108.3 supports the wheel bearing unit 108.1 via the primary suspension unit 105.

Hence, other than with conventional suspension systems for rail vehicles, where the primary suspension is typically located kinematically in series between the axle unit and the running gear frame (i.e., if theoretically mapped to FIG. 2, would conventionally be located between the support unit 108.3 and the running gear frame 104), the present variant integrates the primary suspension within the axle unit 108.

By this integration of the primary suspension unit 105 into the axle unit 108, only the wheel unit 107 and wheel bearing unit 108.1 still pertain to the primary unsprung mass of the rail vehicle 101. Hence, the present solution greatly reduces the primary unsprung mass, while still using comparatively simple and robust components. Thus, while of course still possible, less focus has to be put on the weight reduction of the components of the wheel arrangement 103. This, in particular, allows use of different and/or less costly materials for the components of the wheel unit 107 and the axle unit 108, such as lower grade steel or the like, which are eventually less susceptible to damage, crack propagation etc.

It will be appreciated, however, that with other variants, the primary suspension unit 105 can basically be located at any other desired and suitable point along the kinematic chain between the wheel unit 107 and the rail vehicle structure, e.g., the running gear frame 104.

In particular, the primary suspension unit 105 may be located more or less remote from the wheel unit 107.

It will be appreciated that, in principle, the primary suspension unit 105 may be integrated within the axle unit 108 at any desired and suitable location in the kinematic chain between the wheel support unit 108.3 and the wheel bearing unit 108.1. Moreover, the type and working principle, respectively, of the primary suspension unit 105 may be adapted to the location of the primary suspension unit 105. In any case, of course, the design and location of the primary suspension unit 105 is adapted and, preferably, optimized, to the loads to be expected during operation of the vehicle 101.

In the present example, a gap 109 is formed between the wheel support unit 108.3 and the wheel bearing unit 108.1. The primary suspension unit 105 is connected to the wheel support unit 108.3 and the wheel bearing unit 108.1 in such a manner that the primary suspension unit 105 bridges a part of the gap 109. By this means a very simple integration of the primary suspension of unit 105 into the axle unit 108 is achieved. In practice, the location and orientation of the gap 109 and the bridging primary suspension unit 105 may be comparatively easily adapted to the loads to be expected during operation of the vehicle 101.

The wheel bearing unit 108.1 has a central recess 110, wherein the wheel support unit 108.3 extends into and through the recess 110, such that a particularly compact design is achieved. By means of the wheel support unit 108.3 reaching through this recess 110 support can be provided to the wheel bearing unit 108.1 on both lateral sides of the wheel bearing unit 108.1. Such a configuration is also particularly beneficial in terms of failure safety and failure running properties, since even upon failure of the primary suspension unit 105 dislocation of the wheel unit 107 from the axle unit 108 may be prevented by simple safety means as will be explained further below.

It will be appreciated that the recess 110 of the wheel bearing unit 108.1 may generally be of any arbitrary design and shape as long as it allows the wheel support unit 108.3 to reach into the recess 110 under any conditions to be expected during normal operation the vehicle 101. With particularly simple variants allowing compact designs, the recess 110 has a recess axis, wherein the recess axis, in an unloaded state of the wheel arrangement 103, extends at least substantially parallel to the wheel axis of rotation 107.1. Typically, as in the present example, the recess axis substantially coincides with the wheel axis of rotation 107.1.

In the present example, the wheel support unit 108.3 defines a wheel support unit axial direction AD, a wheel support unit circumferential direction CD and a wheel support unit radial direction RD, wherein the wheel support unit axial direction AD, in an unloaded state of the wheel arrangement (as shown in the solid lines in FIG. 2), extends at least substantially parallel to the wheel axis of rotation 107.1.

The wheel support unit 108.3 comprises two radial protrusions in the form of an inner radial web element 108.4 and an outer radial web element 108.5 as well as a central support stub 108.6. The central support stub 108.6 is rigidly connected to the running gear frame 104. Both, radial web elements 108.4, 108.5 protrude from the wheel support unit 108.3 in the wheel support unit radial direction. It will be appreciated that, in the present embodiment, the inner radial protrusion 108.4 is located on an inner side of the wheel bearing unit 108.1, wherein this inner side, during use of the rail vehicle 101 on a track T, (in the vehicle transverse direction, y-axis) faces towards a center of the track T. Consequently, the outer radial protrusion 108.5 is located on an outer side of the wheel bearing unit 108.1, wherein the outer side, during use of the rail vehicle 101, faces away from the center of the track T.

It will be appreciated that, in the present example, the outer radial web element 108.5 is formed by a separate part not directly connected to the central support stub 108.6 of the support unit 108.3 but rather connected to the running gear frame 104. It will be appreciated that, with other variants, the outer radial web element 108.5 may also be in direct contact with the central support stub 108.6 or be an integral part of the central support stub 108.6. Similar applies to the inner radial web element 108.4, which in the present example is disengageably connected to the central support stub 108.6, but may also be an integral part of the central support stub 108.6 in other cases. Similarly, depending on the design of the running gear frame 104, the inner radial web element might also be connected to the running gear frame 104. Furthermore, with certain variants, the respective interface for the primary suspension unit 105 provided by the respective radial web element 108.4, 108.5 might also be directly provided by a surface of the running gear frame 104.

In order to provide resilient support of the wheel unit 107 on the axle unit 103 via the primary suspension unit 105, an inner primary suspension element 105.1 of the primary suspension unit 105 is connected to a face of the inner radial web element 108.4 (facing the wheel bearing unit 108.1) and to the wheel bearing unit 108.1, thereby bridging the gap 109. As can be seen from FIG. 2, the inner primary suspension element 105.1 is connected to an associated inner radial segment 108.7 of the wheel bearing unit 108.1. Furthermore, an outer primary suspension element 105.2 of the primary suspension unit 105 is connected to a face of the outer radial web element 108.5 (facing the wheel bearing unit 108.1) and to the wheel bearing unit 108.1, more precisely to an associated outer radial segment 108.8 of the wheel bearing unit 108.1.

It will be appreciated that the design of the wheel bearing unit 108.1 with the radial segments 108.7 and 108.8 yields a comparatively lightweight design. Nevertheless, with other variants, any other shape of the wheel bearing unit 108.1 may be selected as long as there is an appropriate interface for the respective primary suspension element 105.1 and 105.2, respectively.

It will be further appreciated that, generally, with other variants, one single protrusion or radial web element 108.4, 108.5, respectively, located on one side of the wheel unit 107 may be sufficient. However, as with the present example, beneficial support of the alternating lateral loads acting along the axis of rotation 107.1 of the wheel unit 107 is achieved via the radial protrusions or web element 108.4 and 108.5, located on both the inner and the outer side of the wheel unit 107.

It will be further appreciated that one or more of these radial protrusions or web elements 108.4 and 108.5 may be provided at the same side of the wheel unit 107. Each protrusion 108.4, 108.5 may extend over a certain part of the circumference of the wheel support unit 108.3, the angle of extension along the circumferential direction of the wheel support unit 108.3 depending, in particular, on the number of protrusions 108.4, 108.5 provided on the same side of the wheel unit 107. In particular, as is indicated in FIG. 6 by the double-dot-dashed contour 112.2, in the case of a plurality of primary suspension elements 112.2, respectively, on either side, one protrusion or web element 108.4, 108.5, respectively, may be provided per primary suspension element 105.1, 105.2. Preferably, the respective radial protrusion 108.4, 108.5 extends along the wheel support unit circumferential direction over at least 45%, preferably at least 60%, more preferably at least 80%, of the circumference of the wheel support unit 108.3. In the present example, however, with one ring shaped primary suspension element 105.1, 105.2, respectively, on either side, the respective protrusion or web element 108.4 and 108.5 is a substantially ring-shaped component extending over 100% of the circumference of the wheel support unit 108.3, thereby yielding a very robust and simple design.

With the design as described above, in the present example, the wheel support unit 108.3 defines a radial cavity, the radial cavity 111 extending in the wheel support unit circumferential direction CD and in the a wheel support unit radial direction RD. In the present example, at least a part of the wheel bearing unit 108.1 is inserted, in the wheel support unit radial direction RD, into the radial cavity 111. By this means, a particularly compact configuration is achieved. Moreover, this configuration is particularly beneficial in terms of its failure modes in case of potential failure of the primary suspension unit 105. This is not least due to the fact that the insertion of the wheel bearing unit 108.1 in the radial cavity 111 ensures that the wheel bearing unit 108.1 and, consequently, the wheel unit 107 is generally kept in place on the wheel support unit 108.3 even in case of a failure of the primary suspension unit 105.

As had been explained above, generally, two primary types of relative motion between the parts of the wheel support unit 108.3 and the wheel bearing unit 108.1 which form the bridged part of the gap 109 may be taken into account or considered when integrating the primary suspension unit 105. One is essentially a shear motion which then typically leads to the use of one or more shear spring elements for the primary suspension unit 105. Such a design is shown in the present example and will be described in further detail below.

Another type of motion which might be considered or used for the primary suspension motion is essentially a normal or breathing motion (increasing or decreasing the width of the gap 109). Such a breathing motion could lead to the use of one or more compression spring elements for the primary suspension unit 105. However, as is indicated in FIG. 2 by the dashed contour 112.1, here as well one or more shear spring elements 112.1 could be used within the part of the gap 109 executing the breathing motion during operation. As shown, the breathing motion part of the gap 109 could be located within the recess 110 such that a particularly compact configuration may be achieved. In particular, a more or less conventional primary spring arrangement could be used at the location of the elements 112.1.

Of course, eventually, any combination of these motions and spring elements 105.1, 105.2 and 112.1, respectively, may also be used, in particular, depending on the loads to be expected during operation of the vehicle 101.

In the present embodiment, in a simple, space saving and efficient manner, the respective wheel arrangement 103 further achieves high derailment safety while at the same time keeping the unsprung mass low and maintaining high passenger comfort during operation of the rail vehicle in that the primary suspension unit 105 is configured such that, at least in the static sate of the rail vehicle 101 (i.e., with the rail vehicle 101 standing on a straight level track under nominal loading—as indicated by the dashed contour 116 in FIG. 2) the (virtual) tilt axis 107.2 (see FIGS. 4 and 6) of the wheel unit 107 is located at a height level 107.3 (see FIGS. 2, 3 and 5) below the axis of rotation 107.1 of the wheel unit 107. In this static sate of the rail vehicle 101 the axis of rotation 107.1 of the wheel unit substantially coincides with the longitudinal axis 108.9 of the wheel support unit 108.3.

This tilt axis 107.2 (at least in the static state) runs parallel to the vehicle longitudinal direction (x axis) and is defined by the distribution of the transverse rigidity of the primary suspension unit 105. More precisely, as the primary suspension unit 105 is located above the wheel to rail contact location, a transverse force F (also referred to as lateral load herein) acting in the transverse direction (y axis) at the wheel to rail contact point CP (e.g., as constantly present for wheel to rail pairings with a certain conicity, but also as impact loads as a result of track irregularities or the like) results not only in a transverse (or lateral) deflection of the wheel unit 107 but also in a tilt motion of the wheel unit 107 (also referred to as a lateral track load induced tilt herein) about this tilt axis 107.2 located at height level 107.3 (as is illustrated in FIGS. 2, 6 and 7).

The tilt axis 107.2 (and its height level 107.3) is defined by the primary suspension elements 105.1 and 105.2 of the primary suspension unit 105. More precisely, the primary suspension unit 105 has a primary suspension transverse rigidity PSTR (jointly defined by the primary suspension elements 105.1, 105.2) in the transverse direction, i.e., a direction parallel to the axis of rotation 107.1 (in the static state), and the tilt axis 107.2 is defined by the distribution of the primary suspension transverse rigidity PSTR of the primary suspension unit 105 along the height direction.

This tilt motion of the wheel unit 107 in response to such transverse forces F has a considerable impact on the deflection of the wheel unit 107 at the wheel to rail contact location CP, and, hence, on the derailment safety of the vehicle. As is illustrated in FIGS. 6 and 7, by selecting a suitable distribution of the transverse rigidity TR of the primary suspension unit 105 which locates this (virtual) tilt axis 107.2 at a height level 107.3 below the axis of rotation 107.1 of the wheel unit 107 (see FIG. 7, left), tilt related transverse deflection TD of the wheel unit 107 at the wheel to rail contact location CP can be reduced compared to conventional wheel units 117 where the height level 117.3 of the tilt axis is located at the same level as the axis of rotation 117.1 of the wheel unit 117 (see FIG. 7, right). Hence, in the present example, derailment safety can be increased (over such conventional designs) while at the same time the keeping the overall transverse rigidity TR of the primary suspension unit 105 unchanged. Hence, the unsprung mass can be kept low and passenger comfort may be maintained while reducing the derailment risk or, put otherwise, the unsprung mass may be reduced and passenger comfort may be increased while keeping a given low level of the derailment risk.

It will be appreciated that, in the present example, the primary suspension unit 105, in a neutral or unloaded state, is under a compressive pre-stress in the transverse direction in order to properly adjust the transverse stiffness level or achieve an appropriate transverse stiffness already in this neutral state (with no transverse loads acting on the wheel unit 117), respectively. This compressive pre-stress may simply be achieved by properly selecting the dimensions of the primary suspension unit 105 and the gap 109 in the transverse direction.

It will be appreciated that this concept is particularly useful and effective in singe wheel configurations as in the present example where the primary suspension unit 105 is the major component defining this tilt axis 107.2. However, use of this concept is not limited to single wheel configurations and, for essentially the same reasons, may also have beneficial effects with other configurations (such as e.g., wheel pairs or wheel sets) where a mechanical coupling exists between the two wheel units on both sides of the running gear.

It will be appreciated that, basically, any desired height offset of the tilt axis 107.2 from the axis of rotation 107.1 that has a noticeable positive effect on the lateral track load induced tilt can be sufficient. Typically, the wheel unit 107 has a rail contact surface defining a nominal diameter ND of the wheel unit 107, and the tilt axis 107.2, in the vehicle height direction, in particular, in the static state of the rail vehicle, is located at a tilt axis distance TAD below the axis of rotation 107.1. Preferably, the tilt axis distance TAD is at least 10%, preferably at least 20%, more preferably 15% to 50%, in particular, 25% to 40%, of the nominal diameter ND of the wheel unit 107. These configurations achieve a particularly advantageous reduction of the lateral track load induced tilt of the wheel unit 107.

The distribution of the primary suspension transverse rigidity PSTR can have any desired configuration as long as the desired height offset (or tilt axis distance TAD) of the tilt axis 107.2 with respect to the axis of rotation 107.1 is achieved. In the present example, the primary suspension unit 105 is separated in an upper, first primary suspension part 105.3 and a lower, second primary suspension part 105.4. In the static state of the rail vehicle 101, in the vehicle height direction, the upper primary suspension part 105.3 is located above the axis of rotation 107.1, while the second primary suspension part 107.2 is located below the axis of rotation 107.1 (see FIGS. 5 and 6).

In the direction parallel to the axis of rotation 107.1, the upper primary suspension part 105.3 has a first transverse rigidity PSTR1, while the second primary suspension part 107.2 has a second transverse rigidity PSTR2. To achieve the desired height offset of the tilt axis 107.2 from the axis of rotation 107.1, the first transverse rigidity PSTR1 is lower than the second transverse rigidity PSTR2. Preferably, the first transverse rigidity PSTR1 is 5% to 99%, preferably 25% to 75%, more preferably 40% to 60%, of the second transverse rigidity PSTR2, thereby achieving particularly beneficial results.

It will be appreciated that the above distribution of the primary suspension transverse rigidity PSTR may simply be achieved by two separate primary suspension elements 112.2 (one forming the upper primary suspension part 105.3, one forming the lower primary suspension part 105.4). It may of course also be formed by any desired other number of primary suspension elements 112.2 in either of the upper and lower primary suspension part 105.3, 105.4. In these cases, the primary suspension elements 112.2 may be distributed along an outer circumference of the axle unit 108, thereby achieving a compact configuration. In certain embodiments, to achieve the desired distribution of the primary suspension transverse rigidity PSTR, the number of the primary suspension elements 112.2 in the upper primary suspension part 105.3 may be lower than the number of the primary suspension elements 112.2 in the lower primary suspension part 105.4. In addition or as an alternative, to achieve the desired distribution of the primary suspension transverse rigidity PSTR, the size of at least one of the primary suspension elements 112.2 in the upper primary suspension part 105.3 may be smaller than a size of at least one of the primary suspension elements 112.2 in the lower primary suspension part 105.4.

Similarly, as in the present embodiment, one single primary suspension element on each side of the wheel unit 107 may be sufficient to achieve the desired distribution of the primary suspension transverse rigidity PSTR. Even one single primary suspension element 112.1 per wheel unit 107 (see FIG. 2) may be sufficient to achieve this distribution of the primary suspension transverse rigidity PSTR.

It will be appreciated that, basically, any desired type(s) of primary suspension element(s) may be used to form the primary suspension unit 105 achieving resilient primary suspension in the required degrees of freedom. In particular, primary suspension elements 105 of any desired configuration and shape may be used. These may comprise conventional spring elements, such as, for example helical metal spring elements or rubber spring elements alone or in combination with other components, such as, for example, damping elements etc. Typically these primary suspension elements are of course adapted to the requirements, in particular the loads to be taken, during operation of the rail vehicle 101. For example, one or more block shaped primary suspension elements may be used, i.e., interposed between the wheel bearing unit 108.1 and the wheel support unit 108.3.

In the present example, as noted, the primary suspension unit 105 comprises two ring shaped primary suspension elements 105.1 and 105.2, respectively providing resilient support of the wheel unit 107 on the axle unit 108 (see FIG. 2). Thus, the respective ring shaped primary suspension element 105.1, 105.2 fully surrounds the wheel support unit 108.3. This has the advantage that a particularly beneficial introduction of the loads from the wheel bearing unit 108.1 into the wheel support unit 108.3 is achieved.

In the present example, as noted above, a simple and particularly space saving configuration is achieved in that the primary suspension unit 105 is a shear spring unit. Such shear spring units typically have the advantage that they provide suitable spring motion in their shear direction, typically in a shear plane, while being comparatively rigid in other directions (e.g., in a direction perpendicular to a shear plane of the shear spring unit). In the present case, the two shear spring elements 105.1, 105.2 are arranged and configured such that, in the static state of the rail vehicle (see FIGS. 5 and 6), the respective primary suspension element 105.1, 105.2 is at least primarily (here: substantially exclusively) under a shear stress and under a compressive prestress in the transverse direction. By this means a particularly compact yet effective primary suspension configuration is achieved.

In the present example, the primary suspension elements 105.1, 105.2 are laminated rubber metal spring elements with a plurality of layers 105.5, 105.6. More precisely, the primary suspension elements 105.1, 105.2 have alternating metal layers 105.5 and rubber (or polymer) layers 105.6, the two outer ones of the metal layers 105.5 forming the mounting interfaces of the primary suspension elements 105.1, 105.2. In the present example, the primary suspension elements 105.1, 105.2 are substantially identical. It will however be appreciated that, with other variants, the primary suspension elements 105.1, 105.2 may also differ from each other.

The layers 105.5, 105.6, in the static state of the rail vehicle 101, extend in a plane (xz plane) perpendicular to the transverse direction (y axis). Hence, in a very compact configuration, particularly favorable suspension in the height direction is achieved with at the same time appropriate transverse rigidity PSTR. It will be appreciated that, in principle, any desired and suitable number of layers 105.5, 105.6 may be chosen. In principle (depending on the mounting interface design) a single layer 105.6 may be sufficient. Typically the number of layers 105.5, 105.6 ranges from 1 to 15, preferably 3 to 10, more preferably 3 to 5.

The desired distribution of the primary suspension transverse rigidity PSTR may be achieved in any suitable way by properly choosing the materials used for the primary suspension elements 105.1, 105.2 (or 112.2) and/or by properly distributing the material(s) used for the respective primary suspension element 105.1, 105.2 (or 112.2) and/or by properly choosing the dimensions of the respective primary suspension element 105.1, 105.2 (or 112.2).

In the present example, a particularly simple, space saving and, hence, preferred variant is realized where, across the respective layer 105.5, 105.6, the material composition and the material thickness are substantially uniform. The respective ring shaped primary suspension element 105.1, 105.2 has a plane of main extension (see, e.g., xz plane in FIG. 4 or 6) in which the ring shaped primary suspension element 105.1, 105.2 has an outer circumferential contour 105.7 with a maximum outer diameter MOD and an inner circumferential contour 105.8 with a maximum inner diameter MID. The outer circumferential contour 105.7 defines a first area center of gravity 105.9, whereas the inner circumferential contour 105.8 defines a second area center of gravity 105.10. To achieve the desired distribution of the primary suspension transverse rigidity PSTR, the second area center of gravity 105.10, in the vehicle height direction, is upwardly offset from the first area center of gravity 105.9 by an area center of gravity distance ACGD. The area center of gravity distance ACGD preferably is 5% to 25%, preferably 7.5% to 15%, more preferably 9% to 12%, of the maximum outer diameter MOD. Moreover, in the present example, the first area center of gravity 105.9 and the second area center of gravity 105.10 are at least substantially aligned in the vehicle height direction, thereby also achieving a particularly simple and compact configuration.

It will be appreciated that, basically, the respective outer and inner contour 105.7, 105.8 may have any desired and suitable shape. For example, the respective outer and inner contour 105.7, 105.8 may be at least section-wise polygonal and/or least section-wise curved. In the present example, a particularly simple arrangement is achieved, in that the outer circumferential contour 105.7 and the inner circumferential contour 105.8 is an at least essentially elliptic contour, in the present particular case, an at least essentially circular contour.

The dimensions of the respective outer and inner contour 105.7, 105.8 may be chosen as desired and suitable for the respective rail vehicle 101. With preferred variants, the maximum outer diameter MOD ranges from 100 mm to 1000 mm, preferably 150 mm to 750 mm, more preferably 200 mm to 500 mm. Furthermore, the maximum inner diameter MID may range from 50 mm to 900 mm, preferably 75 mm to 700 mm, more preferably 100 mm to 400 mm. Finally, the area center of gravity distance ACGD may range from 25 mm to 500 mm, preferably 50 mm to 250 mm, more preferably 75 mm to 100 mm. Each of these variants (alone or in arbitrary combination) leads to a particularly advantageous primary spring configuration.

As noted, in the present example, across the respective layer of the primary suspension elements, the material composition and the material thickness are substantially uniform. It will be appreciated that, with other variants, the desired distribution of the primary suspension transverse rigidity PSTR may also be achieved by varying the material properties across one or more of the layers 105.5, 105.6 of the primary suspension elements 105.1, 105.2, in particular across the polymer layers 105.6. In addition or as alternative, the desired distribution of the primary suspension transverse rigidity PSTR may also be achieved by varying the thickness of the material across one or more of the layers 105.5, 105.6 of the primary suspension elements 105.1, 105.2, in particular, across the polymer layers 105.6. This may be achieved, for example, by providing corresponding (arbitrarily but of course suitably shaped) recesses within the respective layer 105.5, 105.6, in particular, in the polymer layers 105.6. It will be appreciated that, in any of these cases, the desired distribution of the primary suspension transverse rigidity PSTR may then also be achieved with substantially concentric outer and inner contours 105.7, 105.8.

It will be appreciated that, in general, the overall or total rigidity of the primary suspension unit 105 may be substantially the same in all three (translatory) directions, i.e., the longitudinal direction, the transverse direction and the height direction. However, as in the present example, the primary suspension unit 105 shows different behaviors in different directions in order to account for the load cases to be expected during operation of the particular vehicle 101. Hence, the primary suspension unit 105 has a longitudinal rigidity PSLR in the longitudinal direction, the transverse rigidity PSTR and a height rigidity PSHR in the height direction (i.e., in three mutually orthogonal directions). With certain variants, the height rigidity PSHR is lower than at least one of the longitudinal rigidity PSLR and the transverse rigidity PSTR (typically lower than the transverse rigidity PSTR, sometimes lower than both the longitudinal rigidity PSLR and transverse rigidity PSTR). By this means, a primary suspension may be achieved which is suitably compliant in the height direction of the vehicle 101, while being comparatively rigid in the transverse direction of the vehicle 101. In the present example, the longitudinal rigidity PSLR is lower than the transverse rigidity PSTR. It may be the case that the height rigidity PSHR is lower than the longitudinal rigidity PSLR. In the primary suspension unit 105 as well as in many other embodiments according to the present design, however, the height rigidity PSHR is at least approximately the same as the longitudinal rigidity PSLR.

It will be appreciated that the wheel support unit 108.3 may, in general, have any desired and suitable shape. Preferably, as in the present example, it is an elongated element, which can be substantially symmetric (typically rotationally symmetric) with respect to an axis 108.8 which (in an unloaded state) is substantially parallel to the axis of rotation 107.1 of the wheel unit 107. With other variants, however, as in the present example, the wheel support unit 108.3 may be a (potentially only slightly) asymmetric component to account for differences in the relative location of its components in their unloaded and loaded state. Moreover, the wheel support unit may be a substantially solid or, as in the present example, a hollow component.

In the present example, the wheel arrangement 103 is configured for use in a motorized implementation. Hence, to achieve a very compact and beneficial configuration, the wheel support unit 108.3 is essentially tube shaped, wherein a drive shaft unit 114, at a first end, is connected to the wheel unit 107 (only shown in a highly schematic way) by a torsionally rigid linkage 115. The drive shaft unit 114 extends through an interior section of the wheel support unit 108.3. The drive shaft unit, at its other (second) end opposite to the first end, is configured to be connected to the drive unit 106 of the rail vehicle 101. To this end, the drive shaft unit 114 has a toothed section 114.1 configured to connect to the drive unit 106. By this means a particularly beneficial and compact design may be achieved.

As can be seen from FIGS. 2 to 4 in an unloaded state of the wheel arrangement (shown in solid lines), the primary suspension elements 105.1, 105.2 have a certain offset (along their shear plane or along the z axis, respectively) between their mounting faces (for mounting to the wheel bearing unit 108.1 and the wheel support unit 108.3, respectively) which holds the wheel unit 107 and the wheel bearing unit 108.1 in such a manner that the axis of rotation 107.1 of the wheel unit is parallel but offset from the longitudinal axis 108.9 of the wheel support unit 108.3. In the (statically) loaded state under nominal load, the wheel unit 107 is pushed upwards with respect to the wheel support unit 108.3 (or vice versa), such that the axis of rotation 107.1 of the wheel unit substantially coincides with the longitudinal axis 108.9 of the wheel support unit 108.3 (as it is indicated by the dashed contour 116). This situation is accounted for in that the linkage 115 can follow this motion and in that the wheel support unit 108 has a slightly asymmetric or eccentric design.

While the present invention, in the foregoing has been mainly described in the context of a shear spring arrangement, it will be appreciated that the primary suspension unit, in principle, may be designed in any other desired and suitable way to achieve resilient primary suspension in the required degrees of freedom. In particular, primary suspension elements of any desired configuration and shape may be used instead of suspension elements 105.1, 105.2. For example, conventional metal spring elements may be used alone or in combination with other components, such as, for example, damping elements etc. Similarly, polymer springs, rubber springs or laminated metal rubber springs may be used alone or in arbitrary combination with other spring and/or damping elements.

Furthermore, while the present invention, in the foregoing, has been mainly described in the context of a single or individual wheel unit, it will be appreciated that the invention may also be used in any other wheel configuration, e.g., in the context of wheel pairs or wheel sets with a torsionally rigid coupling between the wheel units.

While the present invention, in the foregoing has been exclusively described in the context of light rail vehicles, it will be appreciated that the invention can also be applied for any other rail vehicles, in particular, other rail vehicles operating at considerably higher nominal speeds.

The invention claimed is:

1. A wheel arrangement for a rail vehicle, comprising:

a wheel unit; and a support unit, said wheel unit defines an axis of rotation of said wheel unit, said support unit is configured to be connected to a rail vehicle structure of said rail vehicle defining a vehicle longitudinal direction, a vehicle transverse direction and a vehicle height direction;

said support unit is configured to connect said wheel unit to said rail vehicle structure such that said wheel unit is rotatable about said axis of rotation;

said support unit comprises a primary suspension unit configured to provide resilient support of said rail vehicle structure on said wheel unit at least in said vehicle height direction;

said primary suspension unit has a primary suspension transverse rigidity in a direction parallel to said axis of rotation, wherein a distribution of said primary suspension transverse rigidity across said primary suspension unit, in a static state of said rail vehicle on a straight level track under a nominal load, defines a tilt axis of said wheel unit parallel to said vehicle longitudinal direction;

said distribution of said primary suspension transverse rigidity is such that, in said vehicle height direction, said tilt axis is located below said axis of rotation;

said support unit comprises an axle unit with a wheel bearing unit and a wheel support unit; and wherein:

said wheel bearing unit forms a bearing for said wheel unit;

said primary suspension unit is located kinematically in series between said wheel support unit and said wheel bearing unit, such that said wheel support unit is supported on said wheel bearing unit via said primary suspension unit; and/or said wheel support unit is essentially tube shaped.

2. The wheel arrangement of claim 1, wherein:

said wheel unit has a rail contact surface defining a nominal diameter of said wheel unit;

said tilt axis, in said vehicle height direction, is located at a tilt axis distance from said axis of rotation; and said tilt axis distance is at least 10% of said nominal diameter.

3. The wheel arrangement of claim 1, wherein:

said primary suspension unit is separated in an upper, first primary suspension part and a lower, second primary suspension part;

said first primary suspension part has a first transverse rigidity in said direction parallel to said axis of rotation, said first primary suspension part, in said static state of said rail vehicle, is located, in said vehicle height direction, above said axis of rotation;

said second primary suspension part has a second transverse rigidity in said direction parallel to said axis of rotation, said second primary suspension, in said static state of said rail vehicle, is located, in said vehicle height direction, below said axis of rotation; and said first transverse rigidity is lower than said second transverse rigidity, said first transverse rigidity is 5% to 99%, preferably 25% to 75%, more preferably 40% to 60%, of said second transverse rigidity.

4. The wheel arrangement of claim 1, wherein:

said primary suspension unit is a shear spring unit.

5. The wheel arrangement of claim 4, wherein:

said shear spring unit comprises at least one primary suspension element configured to provide resilient support of said rail vehicle structure on said wheel unit; and said at least one primary suspension element is arranged and configured such that, in said static state of said rail vehicle, said primary suspension element is under a shear stress.

6. The wheel arrangement of claim 1, wherein:

said primary suspension unit comprises at least one primary suspension element configured to provide resilient support of said rail vehicle structure on said wheel unit, said primary suspension element comprising at least one of a polymer element, a rubber element, and a laminated rubber metal spring element with a plurality of layers.

7. The wheel arrangement of claim 6, wherein said plurality of layers is configured to extend, in said static state of said rail vehicle, in a plane perpendicular to said transverse direction.

8. The wheel arrangement of claim 1, wherein:

said primary suspension unit has a longitudinal rigidity in said longitudinal direction and a height rigidity in said height direction;

said height rigidity is lower than at least one of said longitudinal rigidity and said transverse rigidity; and/or said longitudinal rigidity is lower than said transverse rigidity.

9. The wheel arrangement of claim 1, wherein:

said primary suspension unit comprises at least one ring shaped primary suspension element providing resilient support of said rail vehicle structure on said wheel unit.

10. The wheel arrangement of claim 9, wherein:

said at least one ring shaped primary suspension element has a plane of main extension;

said at least one ring shaped primary suspension element, in said plane of main extension, has an outer circumferential contour with a maximum outer diameter and an inner circumferential contour with a maximum inner diameter;

said outer circumferential contour defines a first area centroid;

said inner circumferential contour defines a second area centroid; and/or said second area centroid, in said vehicle height direction, is upwardly offset from said first area centroid by an area centroid distance.

11. The wheel arrangement of claim 10, wherein:

at least one of said outer circumferential contour or said inner circumferential contour define a rounded contour;

said maximum outer diameter ranges from 100 mm to 1000 mm, preferably 150 mm to 750 mm, more preferably 200 mm to 500 mm;

said maximum inner diameter ranges from 50 mm to 900 mm, preferably 75 mm to 700 mm, more preferably 100 mm to 400 mm; and/or said area centroid distance ranges from 25 mm to 500 mm, preferably 50 mm to 250 mm, more preferably 75 mm to 100 mm.

12. The wheel arrangement of claim 11, wherein said outer circumferential contour and/or said inner circumferential contour defines an elliptic contour or a circular contour.

13. The wheel arrangement of claim 10, wherein said area centroid distance, in particular, being 5% to 25%, preferably 7.5% to 15%, more preferably 9% to 12%, of said maximum outer diameter; and/or said first area centroid and said second area centroid are aligned in said vehicle height direction.

14. The wheel arrangement of claim 9, wherein said at least one primary suspension element extends along an outer circumference of an axle unit of said support unit.

15. The wheel arrangement of claim 1, wherein:

said primary suspension unit comprises a plurality of primary suspension elements providing resilient support of said rail vehicle structure on said wheel unit;

said plurality of primary suspension elements is distributed along an outer circumference of an axle unit of said support unit;

said primary suspension unit is separated in an upper primary suspension part and a second primary suspension part;

said upper primary suspension part, in said static state of said rail vehicle, is located, in said vehicle height direction, above said axis of rotation;

said second primary suspension part, in said static state of said rail vehicle, is located, in said vehicle height direction, below said axis of rotation;

a number of said primary suspension elements in said upper primary suspension part is lower than a number of said primary suspension elements in said second primary suspension part; and/or a size of at least one of said primary suspension elements in said upper primary suspension part is smaller than a size of at least one of said primary suspension elements in said second primary suspension part.

16. The wheel arrangement of claim 1, wherein said wheel unit has an inner side and an outer side, said wheel unit being configured such that, during use of said rail vehicle on a track, said inner side faces towards a center of said track and said outer side faces away from said center of said track;

at least one inner primary suspension element of said primary suspension unit is located on said inner side of said wheel bearing unit; and at least one outer primary suspension element of said primary suspension unit is located on said outer side of said wheel bearing unit.

17. A rail vehicle unit comprising:

a rail vehicle structure;

at one wheel arrangement of claim 1, connected to said rail vehicle structure;

said rail vehicle structure comprises a running gear unit, a running gear frame, connected to said at least one wheel arrangement; and/or said at least one wheel arrangement is a single wheel arrangement.

18. The wheel arrangement of claim 1, wherein:

a gap is formed between said wheel support unit and said wheel bearing unit;

said primary suspension unit is connected to said wheel support unit and said wheel bearing unit; and said primary suspension unit bridges at least a part of said gap between said wheel support unit and said wheel bearing unit.

19. The wheel arrangement of claim 1, wherein:

said wheel bearing unit has a recess;

said wheel support unit at least partially extends into said recess;

said wheel support unit extends through said recess; and/or said recess defines a recess axis, said recess axis, in an unloaded state of said wheel arrangement, extending at least substantially parallel to said axis of rotation of said wheel unit.

* * * * *